US007987521B2

(12) United States Patent
Vereen

(10) Patent No.: US 7,987,521 B2
(45) Date of Patent: Aug. 2, 2011

(54) SHIRT WITH REINFORCED FRONT

(75) Inventor: William C. Vereen, Thomasville, GA (US)

(73) Assignee: Riverside Manufacturing Company, Moultrie, GA (US)

( * ) Notice: Subject to any disclaimer, the term of this patent is extended or adjusted under 35 U.S.C. 154(b) by 139 days.

(21) Appl. No.: 12/433,352

(22) Filed: Apr. 30, 2009

(65) Prior Publication Data

US 2009/0205101 A1 Aug. 20, 2009

Related U.S. Application Data

(62) Division of application No. 11/118,888, filed on May 2, 2005, now abandoned.

(51) Int. Cl.
*A62B 17/00* (2006.01)
*A41B 1/00* (2006.01)

(52) U.S. Cl. ..... 2/81; 2/115

(58) Field of Classification Search ..... 2/115, 51, 2/81, 458, 119, 92, 120
See application file for complete search history.

(56) References Cited

U.S. PATENT DOCUMENTS

| | | | | |
|---|---|---|---|---|
| 253,483 | A | | 2/1882 | Mott |
| 264,506 | A | * | 9/1882 | Axell ..... 2/115 |
| 267,588 | A | | 11/1882 | Price |
| 681,955 | A | | 9/1901 | Dey |
| 1,798,008 | A | | 3/1931 | Walter |
| 2,275,090 | A | | 3/1942 | Reiss |
| 2,304,251 | A | | 12/1942 | Irving |
| 2,388,234 | A | * | 11/1945 | Abel ..... 2/51 |
| 2,389,152 | A | | 11/1945 | Keeler |
| 2,465,286 | A | | 3/1949 | Silverwteen |
| 2,627,072 | A | * | 2/1953 | Frommelt et al. ..... 2/458 |
| 3,691,564 | A | | 9/1972 | La Marre |
| 4,078,265 | A | | 3/1978 | Condit |
| 4,214,319 | A | * | 7/1980 | Bollag ..... 2/108 |
| 4,397,043 | A | | 8/1983 | Croteau |
| 4,569,088 | A | * | 2/1986 | Frankenburg et al. ..... 2/81 |
| 4,805,244 | A | | 2/1989 | Scott |
| 4,823,404 | A | | 4/1989 | Morell |
| 4,860,382 | A | * | 8/1989 | Markwell ..... 2/457 |
| 4,890,336 | A | | 1/1990 | Worton |
| 4,987,613 | A | | 1/1991 | Loverdi |
| 5,001,781 | A | | 3/1991 | Grilliot |
| 5,060,314 | A | | 10/1991 | Lewis |
| 5,101,511 | A | | 4/1992 | Elverskog |
| 5,172,426 | A | | 12/1992 | Capello |
| 5,210,878 | A | | 5/1993 | Triche |
| 5,446,927 | A | | 9/1995 | Weldon |
| 5,496,623 | A | | 3/1996 | Fox |
| 6,296,023 | B1 | | 10/2001 | Gehrhardt |
| 6,604,248 | B1 | | 8/2003 | Brown |
| 6,787,228 | B2 | * | 9/2004 | Campbell et al. ..... 428/365 |
| 6,839,909 | B1 | | 1/2005 | Price |
| 6,978,480 | B2 | | 12/2005 | Grilliot |
| 7,043,766 | B1 | * | 5/2006 | Foreman et al. ..... 2/81 |
| 7,065,950 | B2 | * | 6/2006 | Zhu et al. ..... 57/255 |
| 7,156,883 | B2 | * | 1/2007 | Lovasic et al. ..... 8/115.51 |
| 7,168,140 | B2 | * | 1/2007 | McKee et al. ..... 28/167 |
| 7,182,991 | B1 | * | 2/2007 | Hirschmann et al. ..... 428/86 |
| 7,578,005 | B2 | * | 8/2009 | Vereen ..... 2/69 |
| 2002/0016985 | A1 | | 2/2002 | Kelleher |

(Continued)

*Primary Examiner* — Alissa L Hoey
(74) *Attorney, Agent, or Firm* — Smith, Gambrell & Russell

(57) ABSTRACT

A shirt is described that uses a double layer of fabric, strategically located across its front to protect the torso of the wearer.

6 Claims, 2 Drawing Sheets

U.S. PATENT DOCUMENTS

2003/0203688 A1* 10/2003 Campbell et al. ..... 442/130
2004/0029473 A1* 2/2004 McKee et al. ..... 442/181
2004/0060093 A1 4/2004 Harper
2004/0226070 A1* 11/2004 Grilliot et al. ..... 2/81
2004/0235383 A1* 11/2004 Perry et al. ..... 442/344
2005/0032449 A1* 2/2005 Lovasic et al. ..... 442/209
2005/0130533 A1* 6/2005 Lapierre ..... 442/197
2005/0204718 A1* 9/2005 Zhu et al. ..... 57/255
2005/0208855 A1* 9/2005 Zhu ..... 442/302
2005/0208856 A1* 9/2005 McKee et al. ..... 442/302
2005/0277353 A1* 12/2005 Lovasic et al. ..... 442/414
2005/0287364 A1* 12/2005 Zhu et al. ..... 428/357
2006/0242750 A1* 11/2006 Vereen ..... 2/115
2006/0292953 A1* 12/2006 Ashley et al. ..... 442/197
2007/0094763 A1* 5/2007 Silver ..... 2/69
2010/0043116 A1* 2/2010 Vereen ..... 2/81

* cited by examiner

SHIRT WITH REINFORCED FRONT

This divisional application claims the benefit of U.S. patent application Ser. No. 11/118,888, filed May 2, 2005 now abandoned, and is incorporated by reference.

FIELD OF THE INVENTION

This invention is directed to a shirt having a front that is reinforced to protect the torso of the wearer.

BACKGROUND OF THE INVENTION

Workers in many industries may be subjected to sudden thermal flashes directly in front of them. Electrical workers, for example, may experience an electric arc of great thermal intensity. This is particularly damaging to female workers because their brassieres may ignite outright, or the fabric and underwire melt or burn, causing severe injury. The traditional market solution has been to require that female employees exposed to these types of danger wear a brassiere made of a flame resistant fabric. This solution had its problems for the employer because such brassieres are expensive and are often difficult to fit and procure. There are also problems for the female employee in that such brassieres are made from a fabric having flame resistant fibers, which fabric is heavier than the female employee's regular brassiere fabric, and is somewhat stiff, uncomfortable and cumbersome.

Rather than focusing on the brassiere, the present invention is directed to providing the necessary protection for the employee by using a double layer of fabric strategically located across the front of the shirt. The double layers of fabric are significantly more protective than a single layer.

The double fabric layer is applied only in the front panels of the shirt for reasons, including the following:

1. Accidents involving electric arcs in work situations generally occur while the affected employee is working with his or her hands on a given task, and therefore generally occur in front of the affected employee. Infrared energy is the primary heat energy from an electric arc. It travels in a straight line and generally does not affect the back of a garment.
2. Most employees wear arc-rated gloves that extend to the elbow and are often also wearing full rubber sleeves that start at the wrists and go to the top of the shoulder (held in place with a strap that buckles around the back of the shoulders). This leaves a zone from the chest to the abdomen where a flame resistant shirt is the primary means of protection. The rubber sleeves and gloves are generally worn over a long sleeve flame resistant shirt or jacket. The gloves and sleeves have ATPVs that range from 25-100 calories square centimeter. Accordingly, the shirt needs little protection in the sleeve area if gloves and rubber sleeves are being utilized. For this reason, the main purpose for long sleeves in this application is for comfort under the heavy rubber. Lighter materials are the best for this purpose. Since the invention limits shirt construction to a double layer on the front panels only, the sleeves of the invented design are comprised of a single layer of fabric. The resulting thinness of the sleeves allows greater dexterity and the single layer construction of both the sleeves and rear of the shirt allow the employee's rear shoulder and back to ventilate heat and reduce the risk associated with heat build-up.
3. Typical shirts have an ATPV between 4.2-5.6 calories square centimeter. The highest scoring shirts that are presently commercially available are made from a flame resistant fabric known as Indura Ultra Soft® weighing 7.0 ounce per square yard. This fabric is desirable because it has an ATPV of 8.2 calories per square centimeter. The main reason that shirts manufactured from this fabric are not the industry's only choice is because they are heavy and hot. Heavier clothing traps heat and can result in excessive perspiration, (which can conduct electricity) heat exhaustion, heat stroke or other serious medical conditions which can affect the employee's judgment and dexterity on the job.

Construction of shirts with double layers of frontal shirt fabric yields greatly increased protection in the chest/abdomen area with greater breathe-ability and reduced heat retention. It provides the manufacturer the ability to use double layers of lighter material in the front panels and one light layer everywhere else, instead of using a heavier-weight flame resistant fabric to construct the entire shirt.

The present invention allows easier enforcement of flame resistant uniform policies, which can be problematic for the employer for both male and female employees. Is the female employee wearing a Nomex IIIA® brassiere or the male employee wearing a 100% cotton undershirt? The invention's double ply construction provides equal or better protection and will have a distinctive front insignia to allow an employer to readily determine that the employee is compliant with the employer's uniform requirements.

The benefits of this type of construction extend to numerous other applications and the present application is in no way intended to be limited solely to shirts for female employees, nor solely to the type of sewing construction utilized in the attached drawings as being the definitive means of construction. By way of example, the drawings illustrate a construction that includes the entire front panel, however because of cost or in an effort to further reduce heat retention, a customer might direct that the design be altered to utilize the double ply front panel construction above the belt line and a single ply construction on that part of the shirt that is to be tucked into the pants. Also, in some cases it may be desirable to provide double layers in other areas.

DISCLOSURE OF THE PRIOR ART

Applicant is aware of no prior art directly relevant to the present invention.

SUMMARY OF THE INVENTION

Figure 1:
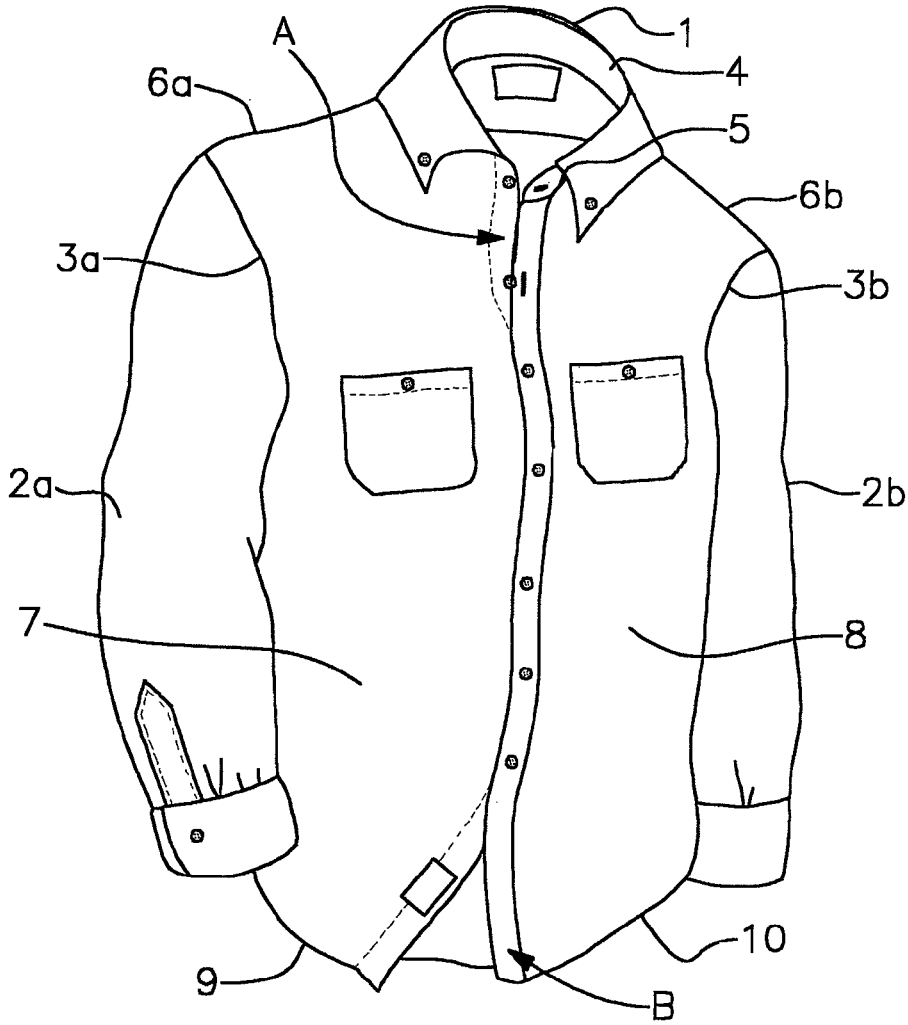
FIG. 1 is a front perspective view illustrating a shirt embodying the present invention.

In accordance with the present invention a shirt is provided that greatly increases the frontal resistance to the thermal effects of an electric arc with a minimum increase in weight by strategically applying a second ply of fabric in the front of a shirt.

DETAILED DESCRIPTION OF THE DRAWINGS

Reference will now be made to the preferred embodiments of the invention and illustrated in the drawings.

In FIG. 1, a shirt 1 comprises sleeves 2*a* and 2*b*, which extend from armholes 3*a* and 3*b*. There is a collar 4 formed above the neck opening 5. Shoulder seams 6*a* and 6*b* extend from armholes 3*a* and 3*b* to neck opening 5. Left front panel 7 and right front panel 89 are constructed from two-ply of fire resistant fabric. The plies are stitched together at the neck opening 5, the shoulder seams 6*a* and 6*b*, at the bottom edges 9 and 10 and around the armholes 3*a* and 3*b*. The sleeves 2*a* and 2*b*, as well as the collar 4, and the back of the shirt (not shown) are constructed of a single ply and not necessarily of fire resistant fabric. A principal purpose of the invention is to provide the two-ply of fire resistant fabric only where it is needed in the front panels.

Figure 2:
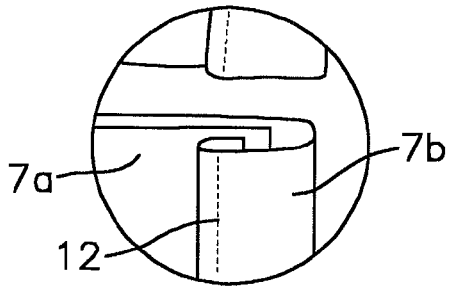
FIG. 2 is a detail view from the inside of a section of the shirt at point A of FIG. 1

FIG. 2, which is a detailed view from the inside of the shirt 1, at point A of FIG. 1, illustrates the bottom ply 7*a*, and the top ply 8*b* and how they are folded and sewed at stitch line 12.

Figure 3:
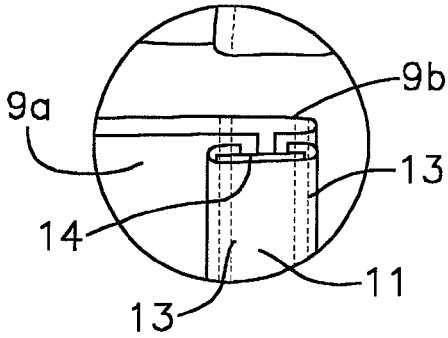
FIG. 3 is a detail view from the inside of a section of the shirt at point B of FIG. 1

FIG. 3, which is a detailed view of shirt 1, at point B of FIG. 1, illustrates the bottom ply 9*b*, and the top ply 9*a* and how they are folded in preparation for sewing. A button panel 11, is applied above the abutted edges of plies 9*a* and 9*b*, and sewn thereto along stitch lines 13. A strip 14 may be inserted within the button panel 11 to provide additional bulk and strength.

Figure 4:
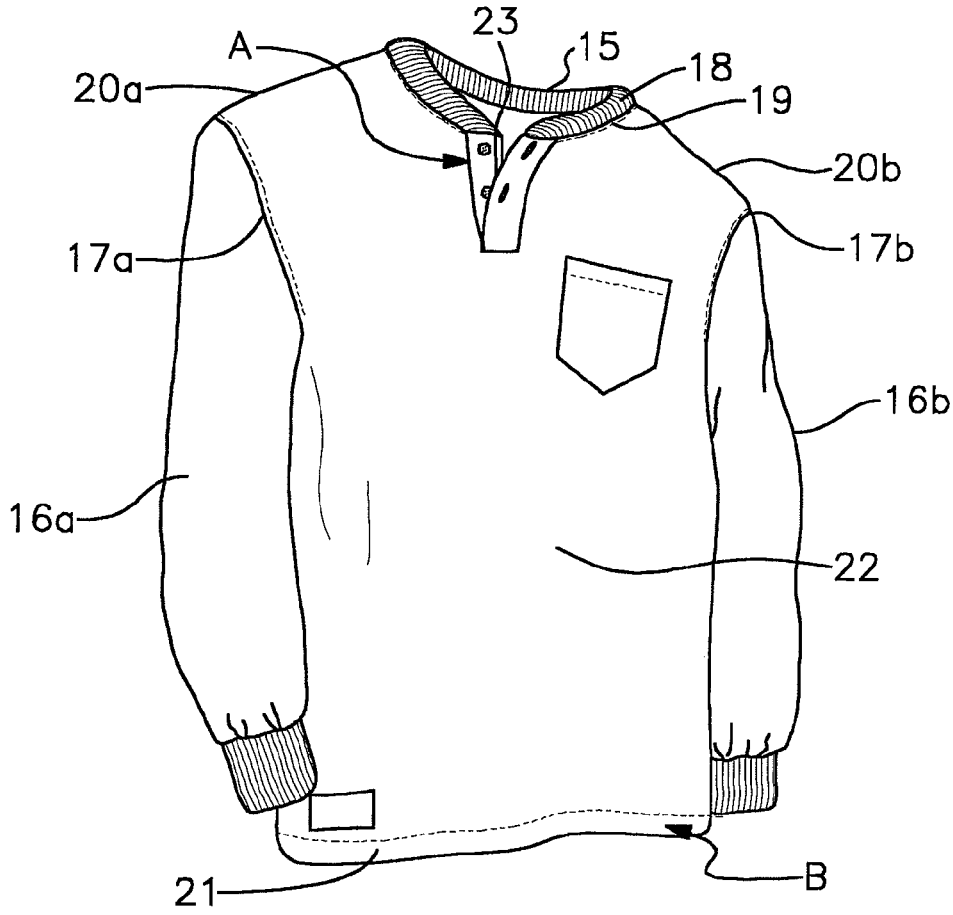
FIG. 4 is a front perspective view illustrating an alternate shirt embodying the present invention

FIG. 4 illustrates another embodiment of the invention. The knit shirt 15 has sleeves 16*a* and 16*b*, which extend from armholes 17*a* and 17*b*. It has a collar 18 formed above neck opening 19. Shoulder seams 20*a* and 10*b* extend from armholes 17*a* and 17*b* to neck opening 19. There is a collar 18 formed above the neck opening 19. Shoulder seams 20*a* and 20*b* extend from armholes 17*a* and 17*b* to neck opening 19. Front panel 22 is constructed from two-ply fire resistant knit fabric. The plies are stitched together at the neck opening 19, the shoulder seams 20*a* and 20*b*, at the bottom edge 21 and around the armholes 17*a* and 17*b*. The sleeves 16*a* and 16*b*, as well as the back (not shown) are constructed of a single ply of fabric and not necessarily fire resistant.

Figure 5:
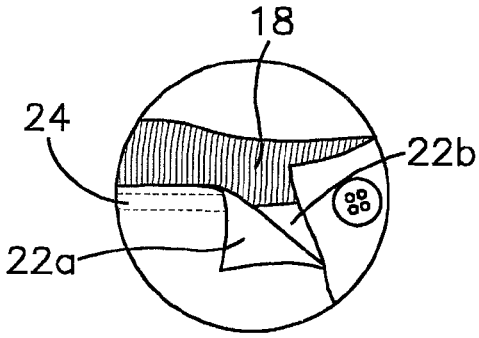
FIG. 5 is a detail view from the outside of a section of the shirt at point A of FIG. 4

FIG. 5 is a detailed view of collar opening 23, taken at point A. It illustrates the top ply 22*a* and the bottom ply 22*b* and how they are sewn to the collar 18 at stitch line 24.

Figure 6:
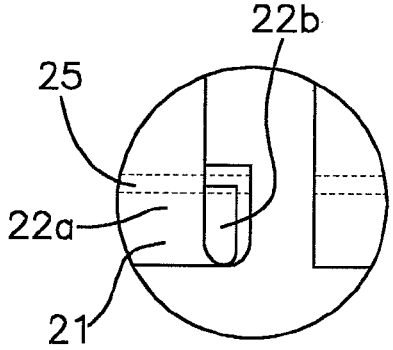
FIG. 6 is a detail view from the outside of a section of the shirt at point B of FIG. 4

FIG. 6 is a detailed view of the bottom edge 21, taken at point B. It illustrates the top ply 22*a* and the bottom ply 22*b* and how they are folded and sewn together along stitch line 25 to form the bottom edge 21.

It will be further apparent to those skilled in the art that various modifications and variations can be made in the device and method of the present invention without departing from the spirit or scope of the invention. Thus, it is intended that the present invention cover the modifications and variations of this invention provided they come within the scope of the appended claims and their equivalents.

The invention claimed is:

1. A torso-covering garment having a front portion comprising at least two plies of fire resistant fabric, each fire resistant fabric ply having an arc thermal performance value (ATPV) of greater than 4.2 calories per square centimeter; a neck opening at the top of said front portion; a hem along the bottom of said front portion; stitching, around said neck opening and along said hem, which holds together the two or more plies of fire resistant fabric, having an ATPV of greater than 4.2 calories square centimeter, which comprise the said front portion, and wherein the said front portion further comprises a left panel and a right panel, which are joined together by overlapping button hole panels; and stitching along said button hole panels which holds together the two or more plies of fire resistant fabric, having an ATPV of greater than 4.2 calories per square centimeter, which comprise the said front portion, and a back portion constructed of fabric having an ATPV of equal to or less than 4.2 calories per square centimeter.

2. The torso-covering garment of claim 1, which includes sleeves, constructed of fabric having an ATPV of equal to or less than 4.2 calories per square centimeter.

3. A torso-covering garment having a front portion comprising at least two plies of fire resistant fabric, each fire resistant fabric ply having an arc thermal performance value (ATPV) of greater than 4.2 calories per square centimeter, a neck opening at the top of said front portion and a hem along the bottom of said front portion; stitching, around said neck opening and along said hem, which holds together the two or more plies of fire resistant fabric, having an ATPV of greater than 4.2 calories per square centimeter, which comprise the said front portion, and wherein the said front portion further comprises a left panel and a right panel, which are joined together by overlapping button hole panels; and stitching along said button hole panels which holds together the two or more plies of fire resistant fabric, having an ATPV of greater than 4.2 calories per square centimeter, which comprise the said front portion, and a back portion constructed of a single ply of fabric.

4. A torso-covering garment having a front portion comprised of at least two unbonded plies of fire resistant fabric, each fire resistant fabric ply having an arc thermal performance value (ATPV) of greater than 4.2 calories per square centimeter; a neck opening at the top of said front portion; a hem along the bottom of said front portion; stitching, around said neck opening and along said hem, which holds together the two or more unbonded plies of fire resistant fabric, having an ATPV of greater than 4.2 calories per square centimeter, which comprise the said front portion, and wherein the said front portion further comprises a left panel and a right panel, which are joined together by overlapping button hole panels; and stitching along said button hole panels which holds together the two or more unbonded plies of fire resistant fabric, having an ATPV of greater than 4.2 calories per square centimeter, which comprise the said front portion, and a back portion, constructed of fabric having an ATPV of equal to or less than 4.2 calories per square centimeter.

5. The torso-covering garment of claim 4, which includes sleeves, constructed of fabric having an ATPV of equal to or less than 4.2 calories per square centimeter.

6. A torso-covering garment having a front portion comprised of at least two unbonded plies of fire resistant fabric, each fire resistant fabric ply having an arc thermal performance value (ATPV) of greater than 4.2 calories per square centimeter; a neck opening at the top of said front portion and a hem along the bottom of said front portion; stitching, around said neck opening and along said hem, which holds together the two or more unbonded plies of fire resistant fabric, having an ATPV of greater than 4.2 calories per square centimeter, which comprise the said front portion, and wherein the said front portion further comprises a left panel and a right panel, which are joined together by overlapping button hole panels; and stitching along said button hole panels which holds together the two or more unbonded plies of fire resistant fabric, having an ATPV of eater than 4.2 calories per square centimeter which comprise the said front portion, and a back portion constructed of a single ply of fabric.

* * * * *